US005133691A

United States Patent [19]

Karlsson

[11] Patent Number: 5,133,691

[45] Date of Patent: Jul. 28, 1992

[54] SUCTION HOOD FOR INJURIOUS GASES

[75] Inventor: Håkan R. Karlsson, Eslöv, Sweden

[73] Assignee: AB Ph. Nederman & Co., Helsingborg, Sweden

[21] Appl. No.: 647,841

[22] Filed: Jan. 30, 1991

[30] Foreign Application Priority Data

Jan. 31, 1990 [SE] Sweden ..... 9000322

[51] Int. Cl.[5] ..... B08B 15/02

[52] U.S. Cl. ..... 454/56; 454/65

[58] Field of Search ..... 98/115.1, 115.3, 115.4; 126/299 D

[56] References Cited

U.S. PATENT DOCUMENTS

| | | | |
|---|---|---|---|
| 380,500 | 4/1888 | Linscott | 126/299 D X |
| 398,968 | 3/1889 | Jones et al. | 126/299 D X |
| 404,194 | 5/1889 | Holm | 126/299 D X |
| 2,905,073 | 9/1959 | Aveni | 126/299 D |
| 3,082,680 | 3/1963 | Nevin et al. | 126/299 D |
| 3,520,115 | 7/1970 | Bowen | 126/299 D X |

FOREIGN PATENT DOCUMENTS

| | | |
|---|---|---|
| 143538 | 9/1981 | Denmark . |
| 2334432 | 7/1977 | France . |
| 8702139 | 5/1987 | Sweden . |

*Primary Examiner*—Harold Joyce
*Attorney, Agent, or Firm*—Tarolli, Sundheim & Covell

[57] ABSTRACT

A said suction hood (1) being connected to a gas extraction system (7) and preferably suspended on a movable arm system (4) permitting the suction hood (1) to be set in various positions relative to an area (2) from which the injurious gases (G) are extracted. For substantially increasing the depth of the suction hood when required, the suction hood (1) includes at least one and preferably three movably mounted wall elements (15, 16, 17) which is or are settable in a folded position or folded positions and which is or are unfoldable into a position or positions wherein it or they gives or give the suction hood (1) a fume cupboard like shape and function.

10 Claims, 6 Drawing Sheets

SUCTION HOOD FOR INJURIOUS GASES

The present invention relates to a suction hood for extraction of injurious gases, said suction hood being connected to a gas extraction system and preferably suspended on a movable arm system permitting the suction hood to be set in various positions relative to an area from which the injurious gases are extracted.

Suction hoods of the above type are already known from e.g. DK 143 538 and SE 8702139-0 and they are distinguished by their slenderness and by the fact that they are not especially deep such that they can be put, leaned or placed at a suitable spot for not being in the way during work and for quick displacement if necessary. These prior art suction hoods can not be used however, if a suction hood with a great depth is required or if a slender suction hood temporarily must be "transformed" into a suction hood with great depth.

The object of the present invention is therefore to provide a suction hood of a similar slender type as previously, but which also can be used when a suction hood with great depth is permanently or temporarily required. According to the invention this is arrived at by means of the characterizing features of claim 1.

A suction hood with these features may be placed on a working surface when required and it is possible to work inside the suction hood, which means that issue of injurious gases into the premises is completely prevented; in many instances a condition for being able to carry out certain jobs. When the work is finished, the suction hood is quickly and by simple manupulations "transformed" into a "slender type" which is easy to handle and in many cases has sufficient suction capacity.

The invention will be further described below with reference to the accompanying drawings, in which FIG. 1 with a perspective view illustrates a suction hood according to the invention obliquely from the front in folded condition and provided on a movable arm system;

Figure 3:
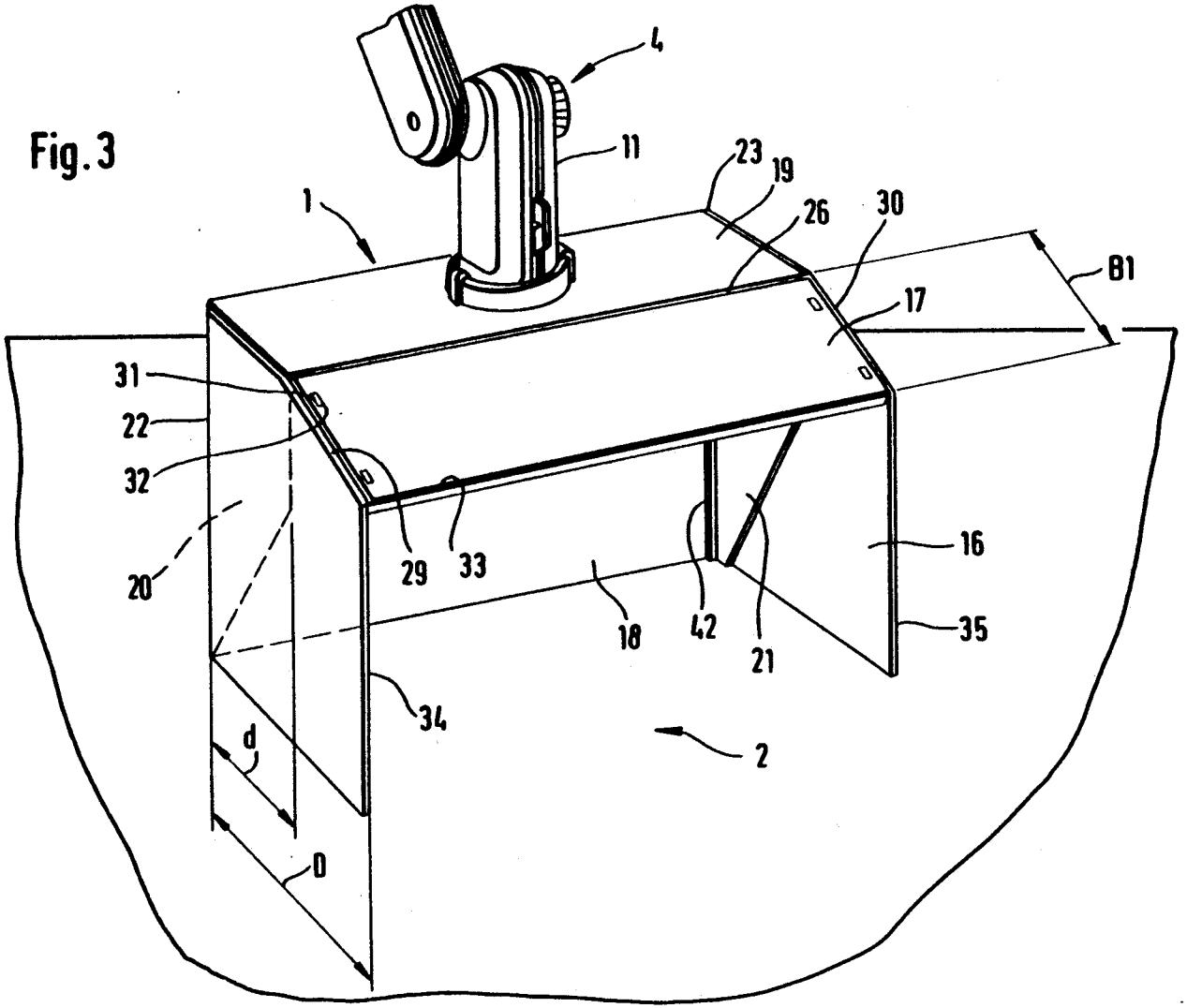
FIG. 3 illustrates, with a perspective view, the suction hood according to the invention obliquely from the front and "transformed" into a fume cupboard like shape.
Figure 4:
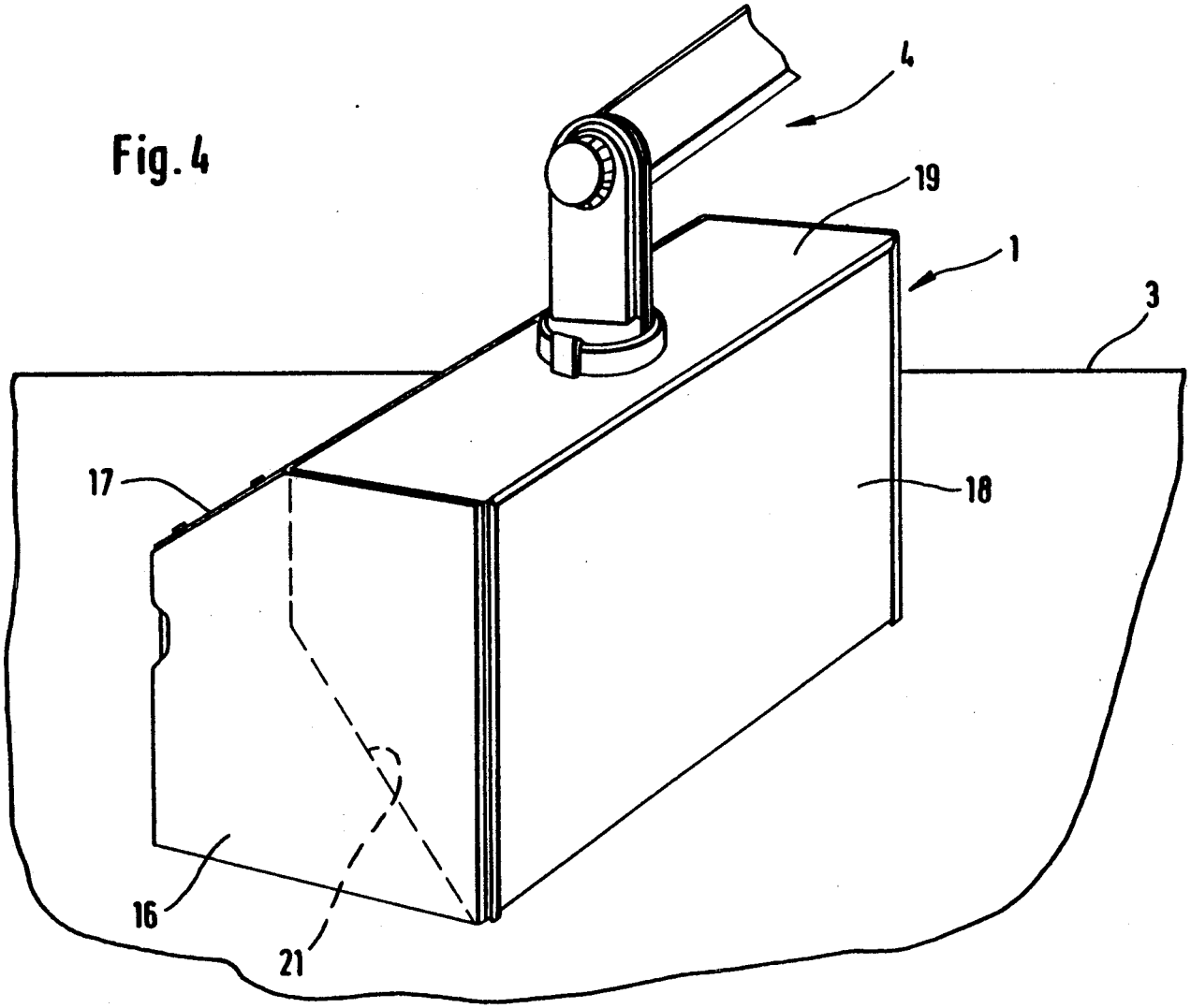
Figure 5:
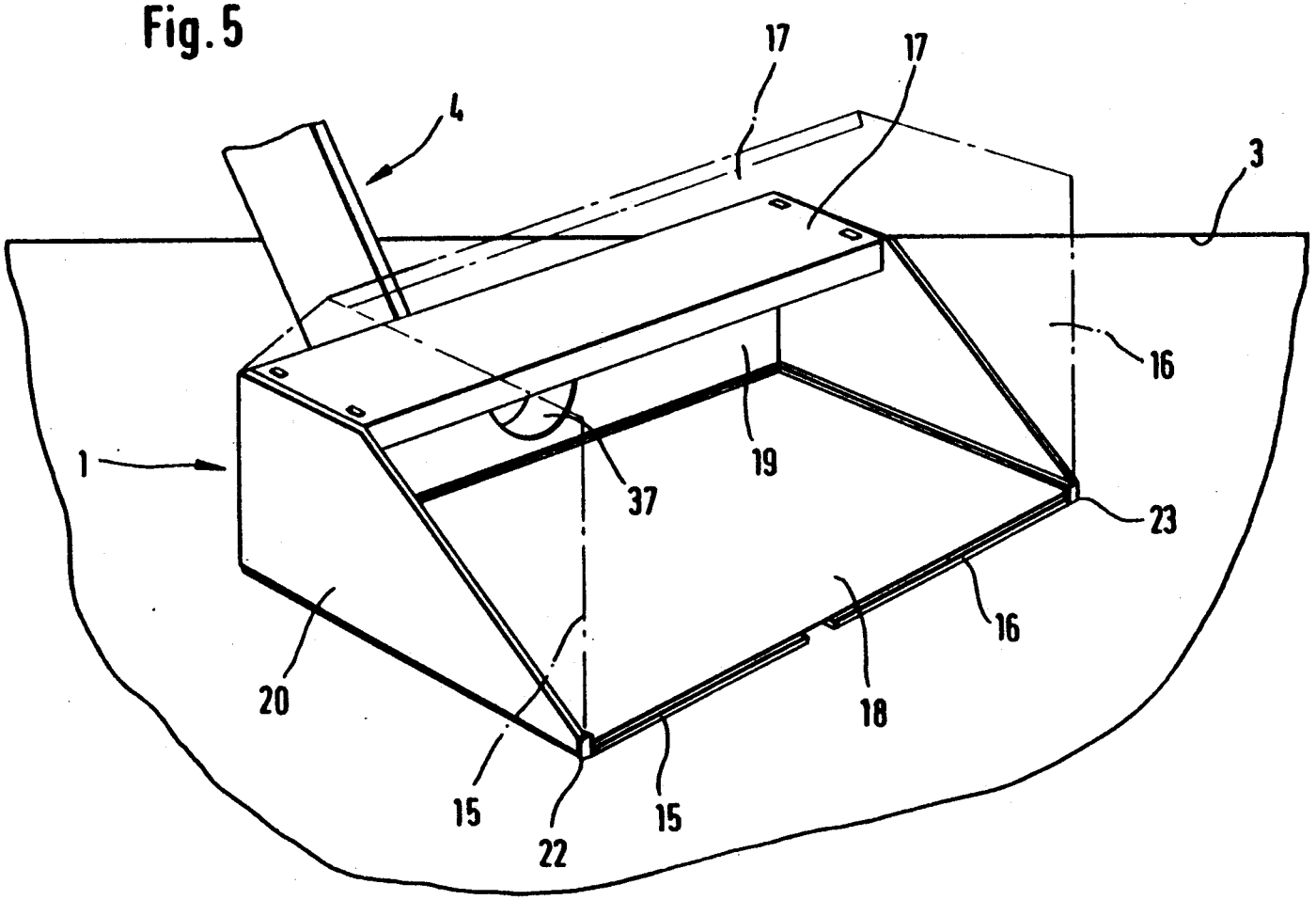
Figure 6:
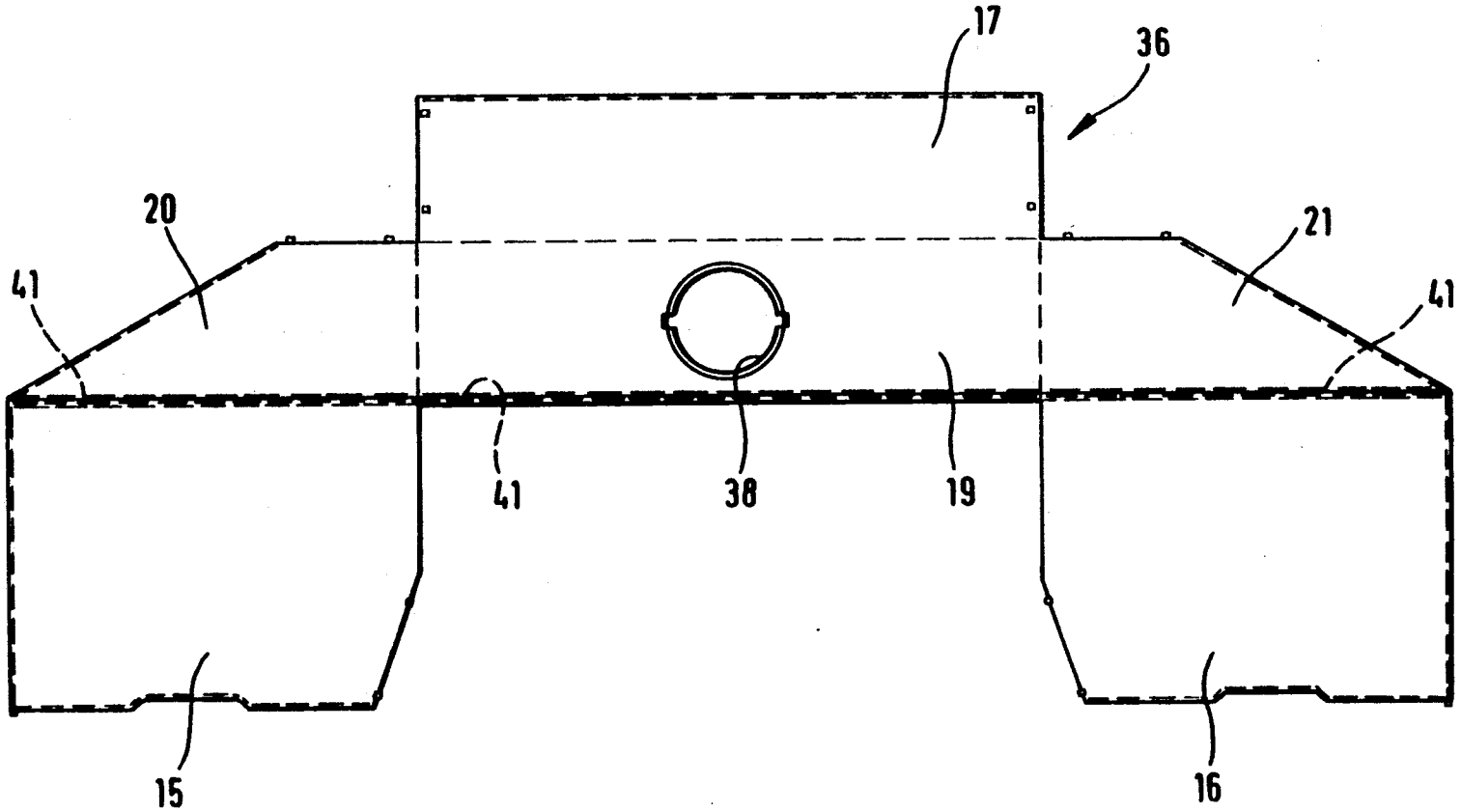

FIG. 4 with a perspective view illustrates the suction hood of FIG. 3 obliquely from the behind;

FIG. 5 illustrates, with a perspective view, the suction hood according to the invention disposed in lying position;

FIG. 6 finally, illustrates, with a plan view, a plastic plate forming a billet from which most walls and members of the suction hood are made.

The suction hood 1 illustrated in the drawings is adapted for extracting injurious gases G from an area 2 wherein such gases are generated. Here, the suction hood is provided on a working table 3 through a movable arm system 4 which is fixedly mounted on said working table 3 by means of a clampable bracket 5. The arm system 4 comprises a "suction arm" 6 forming part of a gas extraction system 7 and consisting of four hollow arm members 8–11, of which the first arm member 8 is connected to the bracket 5 and pivotable in relation thereto about a vertical axis. The arm member 8 is connected to the arm member 9 through a hollow coupling member and the arm member 9 is pivotable relative to the arm member 8 about a horizontal axis. The arm members 9, 10 and 11 are also connected to each other through hollow coupling members and they are pivotable relative to each other about horizontal axes.

The gas extraction system 7 also includes a conduit 12 which connects the "suction arm" 6 to a fan 13 and a filter device 14. The fan 13 is adapted to generate a negative pressure in the gas extraction system and thus, a suction effect in the suction hood 1. The gases G are cleaned in the filter device 14 and discharged to the surroundings in a cleaned state.

Figure 1:
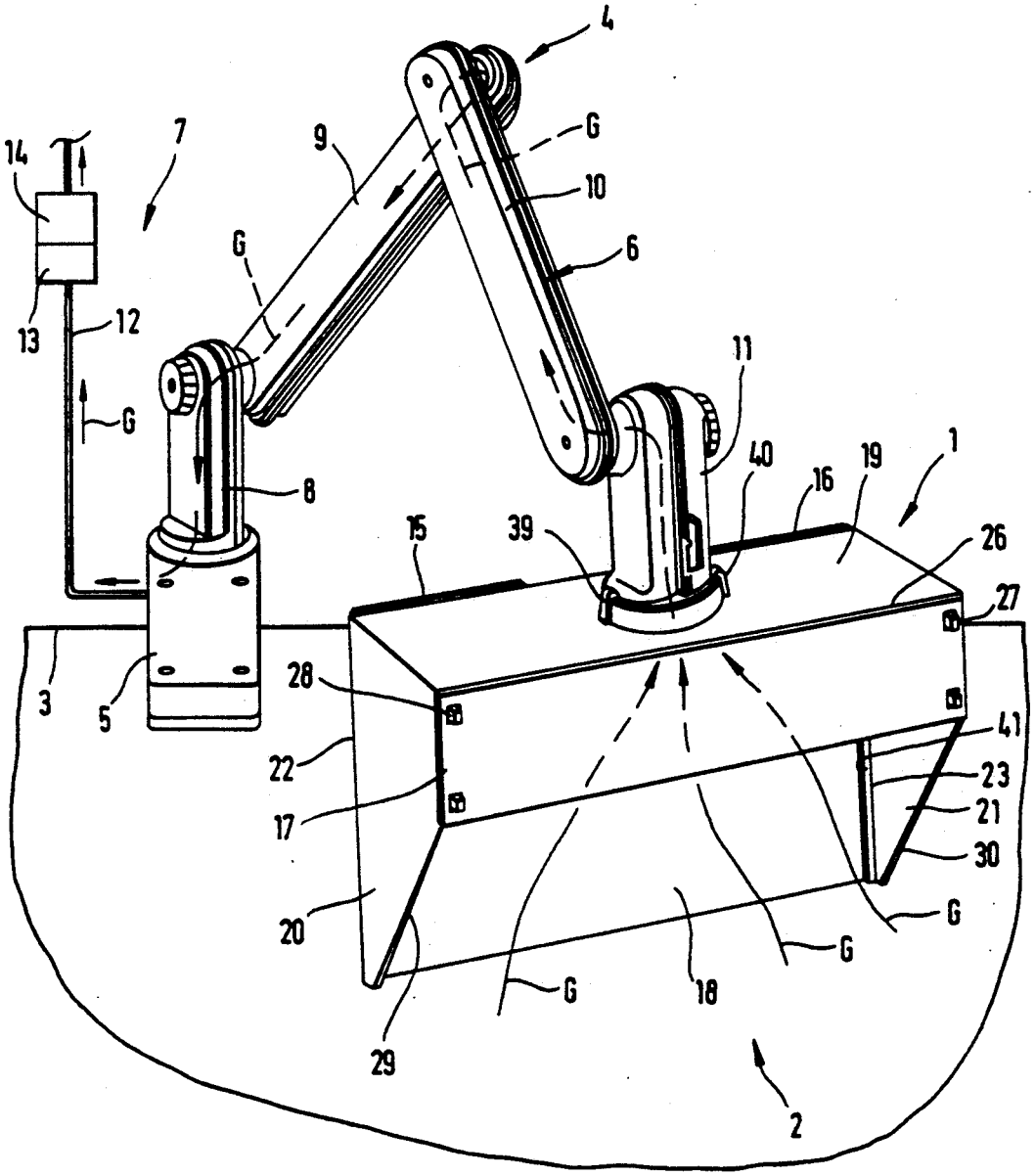

The arm system 4 allows putting the suction hood 1 on the working table 3 as shown in FIG. 1, but it also allows leaning the suction hood in a suitable manner (not shown) or turning and placing it lying on the working table 3 as is shown in FIG. 5. The arm system 4 also permits positioning of the suction hood 1 on many different spots on the working table and easy displacement thereof. Furthermore, the arm-system 4 allows keeping the suction hood 1 set in a suitable position above the working table 3.

Figure 2:
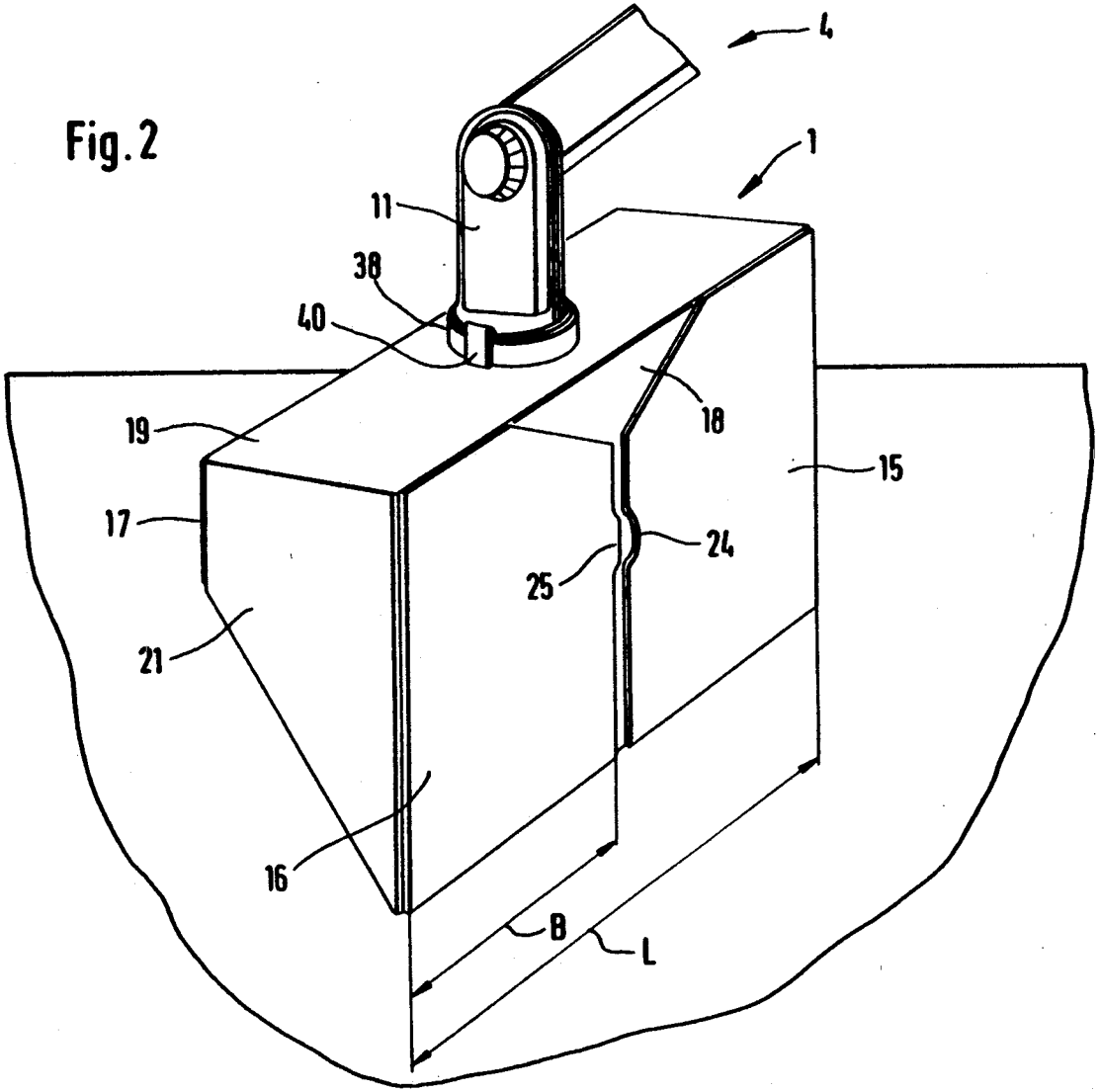
FIG. 2 illustrates, with a perspective view, the suction hood according to the invention in the same condition and obliquely from behind.

At the embodiment of FIG. 1, the suction hood 1 has a depth d which is chosen such as to give the suction hood 1 a "slender" shape and in view of the suction effect which is normally required for sucking out injurious gases G. However, the depth d of the suction hood 1 is in certain cases not sufficient and therefore, said suction hood is provided with three movably mounted wall elements 15, 16 and 17 which can be set in folded positions (see FIGS. 1 and 2) and which are movable to unfolded positions (see FIGS. 3 and 4) for "increasing" the depth of the suction hood from the depth d to the depth D and thus, giving the suction hood a fume cupboard like shape and function. After unfolding the wall elements 15, 16, 17 to the unfolded positions, the suction hood 1 allows for carrying out the gas generating work inside the suction hood 1, whereby it is ensured that no injurious gases are issued into the premises. After finishing such work, the movable wall elements 15, 16, 17 may be moved back to their folded positions, whereby the suction hood 1 regains its "slender" shape.

The suction hood 1 on which the wall elements 15, 16, 17 are movably mounted, consists of a rear wall 18, a top wall 19 protruding forward from the rear wall and two end walls 20, 21 also protruding forward from the rear wall. These walls 18–21 define a "box" which is open in forward-downward direction and which can be kept suspended in various positions of the arm system 4 or placed standing in various positions on the working table 3.

The movable wall element 15 is mounted at the rear edge 22 of the end wall 20 through a flexible portion which provides a "hinge function" such that the wall element 15 is movable from a folded position wherein it extends along the rear wall 18 (see FIGS. 1 and 2) to an unfolded position in which it extends in forward direction along the end wall 20 and a distance beyond the front edges of said end wall 21 (see FIGS. 3 and 4). The movable wall element 16 is mounted at the rear edge 23 of the end wall 21 through a flexible portion which provides a "hinge function" such that the wall element 16 is movable from a folded position wherein it extends along the rear wall 18 (see FIGS. 1 and 2) to an unfolded position in which it extends in forward direction along the end wall 21 and a distance beyond the front edges of said end wall 21.

The movably mounted wall elements 15, 16 preferably have substantially the same height as the rear wall 18 and a width B which is only somewhat smaller than half the length L of said rear wall 18.

Each wall element 15, 16 also have somewhat protruding handle portions 24, 25 and preferably snap portions (not shown) permitting locking of said handle portions onto the rear wall 18.

The movable wall element 17 is mounted on the front edge 26 of the top wall 19 through a flexible portion providing a "hinge function" such that the wall element 17 is movable from a folded position wherein it extends downwards from the top wall 19 and engages those front edges 27, 28 of the end walls 20, 21 which extend downwards parallel to the rear wall 18. The wall element 17 is preferably lockable in this position onto the end walls 20, 21 through suitable snap means.

The wall element 17 is unfoldable (hinged) and in unfolded position positionable on obliquely directed edge portions 29, 30 of the wall elements 15, 16. Furthermore, all three wall elements 15, 16, 17 have coupling portions so as to interconnect the wall elements in their unfolded positions, whereby said wall elements retain each other in these positions. The coupling portions may preferably consist of upwardly directed pegs 31 on the wall elements 15, 16 and holes therefor in the wall element 17. In its unfolded position, the front edge 33 of the wall element 17 preferably extends in substantially the same vertical plane as the vertical front edges 34, 35 of the wall elements 15, 16.

The arm system 4 also permits positioning of the suction hood 1 lying with the rear wall 18 as the bottom in a box like unit (see FIG. 5), wherein the wall elements 15, 16, 17 are directed upwards instead of in forward direction when in unfolded positions (see the dashed and dotted lines in FIG. 5). This position of the suction hood 1 may be of interest particularly if the rear wall 18 is made of heat resistant material, e.g. if it consists of a planar sheet, since such a rear wall 18 can be used for placing hot workpieces thereon.

Thus, the rear wall of the suction hood 1 may consist of a sheet, while the remaining parts thereof are made of a plastic billet 36 to be further described below. The top wall 19 of the suction hood 1 preferably has an aperture 37 which is adapted to direct gases from the suction hood 1 into the suction arm 6. At the aperture 37, the top wall 19 preferably has a collar 38 (which may consist of one or more sections) and two hooks 39, 40. The collar 38 fits onto an end portion of the arm member 11 and the suction hood 1 may be fastened thereto by threading the collar 38 thereof onto said end portion until the hooks 39, 40 lock the suction hood 1 at the arm member 11. By means of this connection, the suction hood 1 may, when required, pivot relative to the arm member 11, which is advantageous while the setting possibilities thereof is thereby increased.

The plastic billet 36 is shown in FIG. 6 and comprises a substantially planar plastic sheet from which the collar 38 and hooks 39, 40 protrude from that portion, which will define the top wall 19. Double rows of longitudinal ribs 41, defining grooves 42 in which the rear wall 18 is fastenable, protrude from portions at the rear edges of the top wall 19 and end walls 20, 21.

On opposite short sides of those portions defining the top wall 19, the plastic billet 36 includes portions which will define the end walls 20, 21. Along a longer side of those portions which define the top wall 19, a portion extends which will define the wall element 17. At rear edges of those members defining the end walls 20, 21, portions extend which will define the wall elements 15, 16. Along the separating lines between the portions defining the top wall 19 and the portions defining the wall element 17, the thickness of the plastic material is preferably reduced to permit a hinge function between these portions. This is preferably also the case for the separating lines between the end walls 20, 21 and the wall elements 15, 16. By folding the plastic billet 36 and put the rear wall 18 in position, the suction hood 1 is completed and connectable to the arm system 4.

The movable wall elements 15, 16, 17 of the suction hood 1 described above and shown in the drawings, do not need to be unfolded simultaneously; in certain cases it can be appropriate to unfold only one or two of the wall elements 15, 16, 17.

The invention is not limited to what is described above and shown in the drawings, but may vary within the scope of the following claims.

As alternatives, not described but within the scope of the claims, one can mention a suction hood with one, two, four or more movably mounted wall elements instead of three such wall elements, or a suction hood with expandable or telescopic or otherwise movably mounted wall elements instead of pivotally mounted elements.

The movable wall elements at the end walls may alternatively be mounted at the front edges of the end walls instead of at their rear edges and the wall element or elements may be fixed in their various positions in other ways and by other means than shown. The wall element or elements may have another suitable size than described and parts of the suction hood may be manufactured in another way than by folding a plastic billet.

At the illustrated gas extraction system 7, the injurious gases are directed from the suction hood 1 through the "suction arm" 6, which defines the movable arm system 4 as well as the gas conduit.

As an alternative to such a "suction arm" 6, one can mention that the arm system 4 comprises pivotally connected arms on which hoses and/or tubes are suspended for directing the injurious gases from the suction hood.

The suction hood is preferably but not necessarily mounted on an arm system. Instead, the suction hood 1 can be freely arranged on a working table or at another suitable spot with or without support means and the suction hood may in this case be connected to a flexible hose or a flexible tube which does not support the suction hood but merely is adapted to discharge the injurious gases therefrom.

I claim:

1. A suction hood for extraction of injurious gases, said suction hood (1) being connected to a gas extraction system (7) including a fan (13) for generating a negative pressure in said gas extraction system for extracting injurious gases (G) from an area (2) in which they are generated, whereby said suction hood (1) is positionable on different spots within the area (2), whereby said suction hood (1) is positionable with a rear wall (18) of said suction hood standing upright and with a top wall (19) extending in a forward direction relative to the area (2) from which the injurious gases (G) shall be extracted, said rear wall (18) includes first and second end walls (20, 21) extending in the forward direction, characterized in that said suction hood (1) also includes first and second side wall elements (15, 16) movable from folded positions to unfolded positions in which said first and second side wall elements (15, 16) extend in the forward direction when said suction hood (1) is positioned with said rear wall (18) standing upright relative to the area (2), said side wall elements (15, 16) being substantially longer in a forward direction than said end walls (20, 21), that said top wall (19) includes an upper wall element (17) movable from a folded position to an unfolded position in which said upper wall element (17) extends in the forward direction from said top wall (19) to give said suction hood (1) a small depth (d) in a direction measured from the front of said suction hood (1) to the back of said suction hood when said movable upper wall element (17) and side wall elements (15, 16) are folded, that said side upper wall element (17) and wall elements (15, 16) when in the unfolded positons give said suction hood (1) a substantially larger depth (D) measured in the direction from the front of said suction hood (1) to the back of said suction hood for giving said suction hood (1) a fume cupboard like shape and function when it is positioned with said rear wall (18) standing upright relative to the area (2), and that when said side wall elements (15, 16) are in the folded positions they extend along said rear wall (18).

2. The suction hood according to claim 1, characterized in that, said first and second side wall elements (15, 16) extend in a forward direction from said first and second end walls (20, 21) when in the unfolded positions.

3. The suction hood according to claim 1 or 2, characterized in that said side wall elements (15, 16) have a width (B, B1) such that when said side wall elements (15, 16) are in the unfolded positions, said suction hood (1) has the fume cupboard like shape with a depth (D) which is about twice as large as the depth (d) of said suction hood (1) when said side wall elements (15, 16) are in the folded positions.

4. The suction hood according to claim 2, characterized in that said side wall elements (15, 16) and said upper wall element (17) are interconnectable when in the unfolded positions for holding said side wall elements (15, 16) and said upper wall element (17) in the unfolded positions.

5. The suction hood according to claim 1, characterized in that said side wall elements (15, 16) are foldable to positions behind said rear wall (18) and that said side wall elements (15, 16) are lockable by means of snap portions to maintain side wall elements (15, 16) in the folded positions.

6. The suction hood according to claim 2, characterized in that said first side wall element (15) is mounted at a rear edge (22) of said first end wall (20) by a portion which provides a hinge function such that said first side wall element (15) is movable from the folded position wherein said first side wall element extends along said rear wall (18) to the unfolded position in which said first side wall element extends along said first end wall (20), that said second side wall element (16) is mounted at a rear edge (23) of said second end wall (21) by a portion which provides a hinge function such that said second side wall element (16) is movable from the folded position wherein said second side wall element extends along said rear wall (18) to the unfolded position in which said second side wall element extends along said second end wall (21) and that said upper wall element (17) is mounted on a front edge (26) of said top wall (19) by a portion providing a hinge function such that said upper wall element (17) is movable from the folded position wherein it engages downwardly directed front edges (27, 28) of said first and second end walls (20, 21) to the unfolded position wherein it engages edge portions (29, 30) of said first and second side wall elements (15, 16).

7. The suction hood according to claim 6, characterized in that each of said first and second side wall elements (15, 16) has a width (B) which is equal to approximately half the length (L) of said rear wall (18).

8. The suction hood according to claim 6, characterized in that said side wall elements (15, 16) mounted on said rear edges (22, 23) of said end walls (20, 21) are lockable by means of snap portions onto said rear wall (18) when in the folded positions and that said upper wall element (17) mounted on said front edge (26) of said top wall (19) is lockable by means of snap portions onto said first and second end walls (20, 21) when said upper wall element (17) is in the folded position and onto said side wall elements (15, 16) when said upper wall element (17) is in the unfolded position.

9. The suction hood according to claim 2, characterized in that said top wall (19), said end walls (20, 21), said first and second side wall elements (15, 16) and said upper wall element (17) are made from a plastic billet (36) by folding said billet.

10. The suction hood according to claim 1, characterized in that said suction hood (1) is suspended on a movable arm system (4) that defines a suction conduit through which gases (G) sucked into said suction hood (1) are discharged.

* * * * *

UNITED STATES PATENT AND TRADEMARK OFFICE

CERTIFICATE OF CORRECTION

PATENT NO. : 5,133,691

DATED : July 28, 1992

INVENTOR(S) : Hakan R. Karlsson

It is certified that error appears in the above-identified patent and that said Letters Patent is hereby corrected as shown below:

Column 5, Line 13, Claim 1, after "and" insert --side--.

Signed and Sealed this

Twelfth Day of October, 1993

*Attest:*

*Attesting Officer*

BRUCE LEHMAN

*Commissioner of Patents and Trademarks*